United States Patent [19]

Maeda et al.

[11] Patent Number: 4,815,418

[45] Date of Patent: Mar. 28, 1989

[54] TWO FLUIDIZED BED TYPE BOILER

[75] Inventors: Sadahiko Maeda; Hideaki Takahashi; Yasumasa Idei; Masahiro Nishida, all of Ube, Japan

[73] Assignee: Ube Industries, Inc., Japan

[21] Appl. No.: 171,254

[22] Filed: Mar. 21, 1988

[30] Foreign Application Priority Data

| | | | |
|---|---|---|---|
| Mar. 23, 1987 | [JP] | Japan | 62-68639 |
| May 26, 1987 | [JP] | Japan | 62-129213 |
| May 26, 1987 | [JP] | Japan | 62-079372[U] |
| Jun. 12, 1987 | [JP] | Japan | 62-090596[U] |

[51] Int. Cl.[4] ..... F22B 1/00

[52] U.S. Cl. ..... 122/4 D; 110/245; 165/104.16

[58] Field of Search ..... 122/4 D; 165/104.16; 110/245; 431/170

[56] References Cited

U.S. PATENT DOCUMENTS

| | | | |
|---|---|---|---|
| 4,499,857 | 2/1985 | Wormser | 122/4 D |
| 4,614,167 | 9/1986 | Bergkvist | 122/4 D |
| 4,681,065 | 7/1987 | Bergkvist | 122/4 D |

*Primary Examiner*—Edward G. Favors

*Attorney, Agent, or Firm*—Finnegan, Henderson, Farabow, Garrett & Dunner

[57] ABSTRACT

A two fluidized bed type boiler comprises: an upstream combustion zone forming a fluidized bed of sand in which pulverized coal is burnt with air fed as a fluidizing gas; a downstream desulfurizing zone forming a fluidized bed of particulate limestone with flue gases stemming from the combustion zone as fluidizing gases; and an intermediate dust collecting zone, in which a baffle plate facing the combustion zone and extending downwards is provided, is arranged between the upstream and downstream zones to form a single and unitary passage for a flow of the flue gases over the three zones.

13 Claims, 5 Drawing Sheets

( INVENTION )

TWO FLUIDIZED BED TYPE BOILER

BACKGROUND OF THE INVENTION

1. Field of the Invention

The present invention relates to an improved fluidized bed boiler used for a combustion of a fuel such as pulverized or crushed coal, by which air pollution due to flue gases discharged from the boiler is reduced. In particular, it relates to a two-bed type boiler comprising an upstream combustion zone forming a fluidized bed of a particulate heat medium and a downstream desulfurizing zone forming a fluidized bed of a particulate sulfur acceptor.

2. Description of the Related Art

As is well known, a fluidized bed boiler comprises a combustion zone defined by a vertically extending vessel of a cylindrical or rectangular shape with a perforated gas distribution plate arranged horizontally and a heat exchanger for producing steam over the plate. A fluidized bed of a particulate heat and fluidizing medium lodged on the plate is formed in an upper part of the zone downstream of the plate and combustion particles such as pulverized coal are supplied downstream of the plate as fuel. Air is fed into a lower part of the zone upstream of the plate as a fluidizing and oxidizing gas and passes upwards through the horizontal plate. The combustion particles in a fluidized state react with the air to generate a combustion heat.

This heat energy is directly or indirectly imparted to the heat exchanger located within the fluidized bed. In the indirect heat transfer, the heat medium particles in the fluidized state are heated and come into contact with the surfaces of the heat exchanger to impart sensitive heat thereto.

In such a conventional fluidized bed boiler, sand or limestone is used. When the limestone is used as the heat and fluidizing medium and also sulfur accepter, it is removed from the boiler after a certain period of the boiler operation and is dumped after the heat energy thereof is recovered.

Solid particles including unburnt coal, spent lime and ash, which are entrained in the flue gases produced in the boiler, are separated from the flue gases by a cyclone. The separated solid particles are then returned to the original boiler or sent to a second combustion or a re-combustion zone provided to form another fluidized bed of the separated solid particle, air is fed as a fluidizing and oxidizing gas, and a fresh combustion material such as coal or heavy oil is fed as a supplemental fuel for re-combustion.

In general, a solid particle fuel such as coal contains non-combusted ash particles, and with such a solid fuel, larger size ash particles are accumulated in the fluidized bed of the boiler during a long operation period of the boiler. These accumulated ash particles are manually periodically discharged from the fluidized bed and dumped after being subjected to a heat recovery process by a heat exchanger provided in the boiler system.

In a prior art fluidized bed boiler of this type, flue gases produced from the boiler are sent to a sulfur removal unit through a conduit communicating the boiler and the removal unit before being discharged out of the boiler system, to prevent air pollution by the sulfur content of the flue gases. The sulfur removal unit removes the sulfur content by techniques such as wet scrubbing with water or other liquids such as glycols or amine and absorption and/or reaction of sulfur oxides on or with solid acceptors such as limestone or the like.

Also, in the prior art, the sulfur removal unit is incorporated with the fluidized bed boiler by a mechanical separator such as a cyclone for separating from the flue gases solid particles such as ash entrained therein.

A conventional fluidized bed boiler is known wherein limestone is used in place of sand as a heat, sulfur acception and fluidization medium, to enable the sulfur content of the flue gases to be removed during the combustion process per se. In this case, however, preferably the boiler is also equipped with a sulfur removal unit in practice, because the sulfur content of the flue gases is not sufficiently removed during the combustion and desulfurizing process by the limestone and thus the flue gases cannot be discharged from the system due to the danger of air pollution. This is due to the practical difficulties encountered when attempting to harmonize an optimum temperature condition for a combustion of the coal with that for a desulfurization of the flue gases, which condition must be applied in the same fluidized bed of limestone, with the result that an efficient desulfurization or sulfur removal is not obtained in the combustion and desulfurizing process.

Recently, an improved fluidized bed boiler was developed, which is a vertically arranged two bed type consisting of an upstream and lower zone forming a fluidized bed of sand for only combustion and a downstream and upper zone forming another fluidized bed of limestone for only desulfurization or sulfur removal. The two zones are separated by a gas distribution plate through which flue gases produced in the lower fluidized combustion bed are passed into the upper fluidized desulfurization bed as fluidizing gases to be desulfurized. The temperature conditions for combustion and desulfurization in the separate fluidized beds are regulated to optimum levels for the respective functions, compared with the conventional one bed type boiler using limestone.

Such a two bed type boiler is more advantageous than the one bed type boiler using limestone and the bed type boiler using sand but provided with the additional sulfur removal unit in reducing the sulfur content from the flue gases to be discharged, while ensuring a high heat efficiency of the entire boiler system.

However, when a low grade and high ash content coal like "culm" is burnt, the inventors have recognized that the upper fluidized bed zone with the limestone does not fully exert the expected inherent ability for desulfurization, for the following reasons. One, that the gas distribution plate separating the two beds is partially clogged, mainly with ash particles entrained in the flue gases, so that the flow per se of the flue gases from the lower combustion bed zone is obstructed; and two, that $CaSO_4$ produced by desulfurization of the sulfur content of the flue gases with the limestone lowers the melting point of the ash, with the result that an increased amount of the ash is deposited on the surface of the particulate limestone, leading to an obstruction of the desulfurization process.

SUMMARY OF THE INVENTION

A first object of the present invention is to overcome the above mentioned disadvantage arising in the conventional two fluidized bed type boiler using a particulate solid fuel containing sulfur and a relatively large amount of ash such as culm by a new two fluidized bed type boiler, to thereby increase the desulfurizing efficiency.

A second object of the present invention is to provide an improved boiler system of the above new two fluidized bed type with an increased combustion efficiency of the system without the addition of a supplement fuel.

A third object of the present invention is to provide a two bed type boiler which is advantageous in the combustion of coal materials including large size ash particles such as "culm".

Other objects of the present invention will be explained with reference to the preferred embodiments of the invention described herein below.

According to the present invention, there is provided a fluidized bed boiler comprising a flue gas and ash producing combustion zone forming a fluidized bed of a particulate heat medium such as sand with air fed as a fluidizing and oxidizing gas and with sulfur-containing combustion particles such as pulverized coal supplied as a fuel, and provided with a heat exchange means therein, and a desulfurizing zone forming a fluidized bed of particulate sulfur acceptor such as limestone with sulfur-containing flue gases stemming from the combustion zone fed as fluidizing gases to be desulfurized and provided with a heat exchange means upstream of the fluidized bed. A dust collecting zone having an outlet for collecting solid particles including fly ash entrained in the flue gases and discharging the collected solid particles through the outlet is provided such that the combustion zone, the dust collecting zone and the desulfurizing zone are arranged in this order to form a single and unitary passage for the flow of the flue gases.

The three zones arranged in the above order are combined to form a lateral unit such that the combustion zone and the dust collecting zone share a first common lateral space, and the dust collecting zone and the desulfurizing zone share a second common lateral space.

The dust collecting zone comprises upper and lower zone parts; the upper zone part having a baffle plate provided to face the combustion zone and extend downwards from the ceiling of the dust collecting zone. The upper zone part is divided by the baffle plate into two chambers communicating with each other only through the lower zone part; wherein one chamber directly communicates with the combustion zone through an opening provided at the top thereof to form an upstream end of the first common lateral space, and the other chamber shares the second common lateral space with a bottom part of the desulfurizing zone upstream of the fluidized bed thereof. The lower part converges downwards to communicate with the outlet of the dust collecting zone.

Preferably, the baffle plate has an upwardly opening trough-like means extending at the bottom over the width thereof for collecting the solid particles guided by the baffle plate. Two conduits each connected to one end of the trough-like means are provided to extend downwards along the inner side wall of the lower part for guiding the collected solid particles toward the outlet. Preferably, the baffle plate facing the combustion zone has a bottom edge line such that a top point is formed at the center between both the bottom corners, from which top point the line extends downwards and toward both the bottom corners. The trough-like means extends along the bent bottom edge line of the baffle plate.

Preferably, the baffle plate is inclined relative to a vertical plane, so that the bottom of the baffle plate is farther from the combustion zone than the top of the baffle plate connected to the ceiling of the dust collecting zone.

The outlet of said collecting zone may communicate with the combustion zone so that at least a part of the discharged solid particles returns to the fluidized bed of the combustion zone.

The fluidized bed boiler may comprise a re-combustion zone forming a fluidized bed of a mixture of solid particles comprising unburned fuel with air fed as a fluidizing and oxidizing gas. Both the combustion zone and the dust collecting zone are communicated with the re-combustion zone so that the solid particles partially discharged from the fluidized bed of the combustion zone and all of the solid particles discharged from the outlet of the dust collecting zone, in combustion, form the fluidized bed of the re-combustion zone. The re-combustion zone communicates with the desulfurizing zone at least at one of positions upstream and downstream of the fluidized bed thereof so that the flue gases are introduced from the re-combustion zone to the desulfurizing zone. A supplemental fuel is not required, since the solid particles including the heat medium supplied from the combustion zone impart sufficient heat energy to burn the unburnt coal supplied from the dust collecting zone.

Preferably, the re-combustion zone communicates with the desulfurizing zone at both the positions upstream and downstream of the fluidized bed thereof, and a means is provided for regulating a ratio of a rate of flue gases introduced upstream of the fluidized bed to that introduced downstream thereof.

The boiler without a re-combustion zone is provided with a selective particle separator communicating with the combustion zone so that the solid particles in the fluidized bed of the combustion zone are partially discharged into the particle separator, for separating the discharged solid particles into smaller size particles and larger size particles. A recycling conduit in cooperation with the separator is provided for returning the smaller size particles to the fluidized bed of the combustion zone.

The other boiler having the re-combustion zone is provided with having a particle separator communicating with the re-combustion zone so that the solid particles in the fluidized bed of the re-combustion zone are partially discharged into the separator provided for separating the discharged particles into smaller size particles and larger size particles. A recycling conduit in cooperation with the separator is provided for returning the smaller size particles to the fluidized bed of the combustion zone.

According to the present invention, there may be provided a plurality of combinations of the combustion zone and the dust collecting zone, and these combinations may be arranged around the single desulfurizing zone.

DESCRIPTION OF THE PREFERRED EMBODIMENTS

Figure 1:
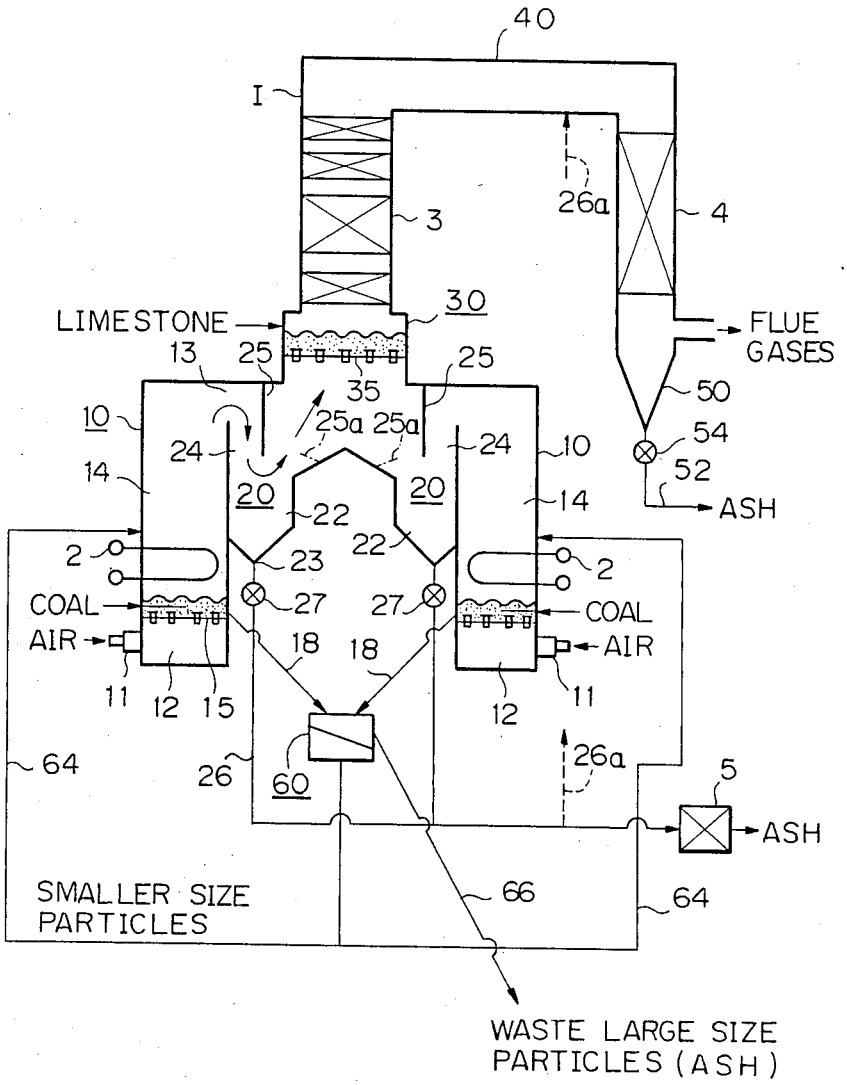
FIG. 1 is a partially sectional view of a boiler of a two fluidized bed type according to the present invention.

FIG. 1 shows a basic embodiment of a two bed type boiler I according to the present invention. Referring to FIG. 1, the boiler I comprises a pair of rectangular vessels forming combustion fluidized beds of sand therein, hereinafter referred to as "combustion zones 10". Each of the combustion zones 10 has a lower chamber 12 and an upper chamber 14 separated by a perforated gas distribution plate 15 arranged horizontally. The lower chamber 12 has an air inlet 11 through which air as a fluidizing and oxidizing gas is fed continuously in the lower chamber 12 and then introduced upwardly through the distribution plate 15 into the upper chamber 14. The upper chamber 14 has a coal inlet through which pulverized coal is supplied continuously into the upper chamber 14, and a conduit type heat exchanger 2 for producing steam is provided in the upper chamber 14. A predetermined amount of sand as a heat and fluidization medium is lodged in advance in the upper chamber 14. The upper chamber 14 has a gas outlet 13 for discharging flue gases from the top of the upper chamber 14.

The boiler I has another pair of vessels forming dust collecting zones 20 laterally adjacent to the corresponding combustion zones 10, respectively. Each of the collecting zones 20 consists of a lower zone part 22 and an upper zone part 24. A baffle plate 25 extends downwards from a closed ceiling of the collecting zone 20 in the upper zone part 24, and divides the upper part zone 24 into two chambers 24*a* and 24*b*. One of the chambers 24*a* in the upper part zone adjacent to the combustion zone 10 shares a lateral space with the combustion zone 10; one end of which space being the gas outlet 13 of the combustion zone 10. The lower part zone 22 of the collecting zone 20 converges downwards and the bottom thereof opens to form a particle outlet 23. The two chambers 24*a* and 24*b* in the upper zone part communicate with each other only through the lower zone part 22.

A single rectangular vessel forming a fluidized bed of particulate limestone is provided, hereinafter referred to as "a desulfurizing zone 30". The desulfurizing zone 30 has lower and upper chambers 32 and 34 separated by a perforated gas distribution plate 35 arranged horizontally. The lower chamber 32 of the desulfurizing zone 30 shares a lateral space with the other chamber 24*b* formed by the upper zone part 24 of the collecting zone 20. The upper chamber 34 of the desulfurizing zone 30 has an inlet for particulate limestone through which a predetermined amount of limestone is supplied in advance as a fluidization medium, and further, a desulfurizing medium or a sulfur acceptor in the upper chamber 34. The used limestone is periodically replaced by fresh limestone. The upper chamber 34 of the desulfurizing zone 30 has a first waste heat boiler 3 provided at a position downstream of the fluidized bed and is connected to a second waste heat boiler 4 by a duct 40. The second waste heat boiler 4 is provided with a conventional mechanical dust collector 50 downstream thereof. The dust collector 50 converges to form an ash outlet connected to an ash treating device (not shown) by a conduit 52 provided with a rotary valve 54. The dust collector 50 also has a duct 56 for discharging the flue gases, which then pass through a bag filter or an electronic dust collector (not shown), and are finally discharged to the atmosphere.

A conventional particle separator 60 is provided for separating solid particles fed therein into larger size particles and smaller size particles. The combustion zone communicates with the separator 60 by a conduit 18 so that the solid particles in the fluidized bed of the combustion zone 10 are partially removed and continuously supplied to the separator 60. The combustion zone 10 and the separator 60 are also connected by a recycling conduit 64 so that the smaller sized particles separated in the separator 60 are continuously returned to the fluidized bed of the combustion zone 10. The sand as the heat and fluidization medium is periodically replaced and/or supplemented by fresh sand, as required. The purged particles are dumped after undergoing a heat recovery process (not shown). The larger size particles separated from the separator 60 are continuously discharged from the boiler system through a conduit 66 and are dumped after undergoing a heat recovery process (not shown).

The outlet 23 of the dust collecting zone 20 is connected to a heat exchanger 5 by a dust conduit 26 with a rotary valve 27, so that the solid particles collected by the collecting zone 20 are periodically discharged from the boiler 1 as waste ash through the heat exchanger 5, wherein a recovery of heat from the ash is carried out.

Alternatively, the line 26 connected to the dust collecting zone at the outlet 23 may be connected to the duct 40 upstream of the second waste heat boiler 4, instead of the heat exchanger 5, as indicated by a dotted arrow 26*a*. In this case, the heat exchanger 5 is omitted from the boiler system.

Figure 2:
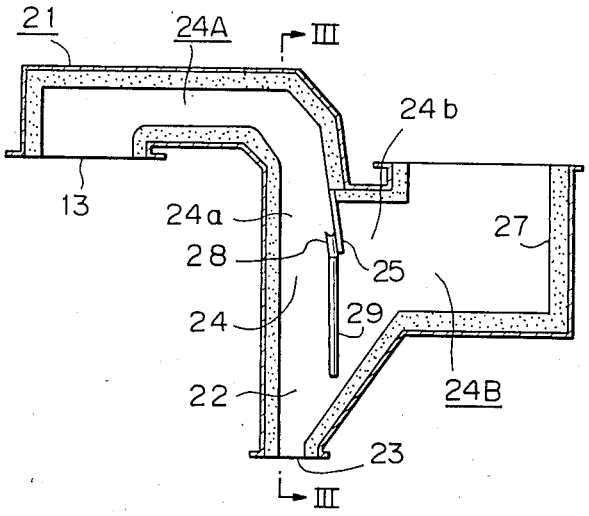
FIG. 2 is a cross sectional view of a dust collecting zone incorporated in the boiler as shown in FIG. 1.
Figure 3:
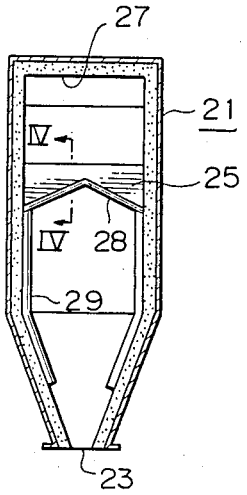
FIG. 3 is a cross sectional view of the dust collecting zone, taken along the line III—III of FIG. 2.
Figure 4:
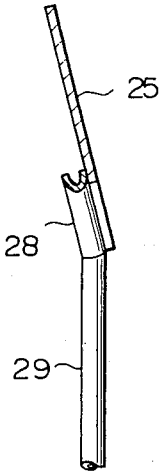
FIG. 4 is a cross sectional view of a baffle plate provided in the dust collecting zone with a trough-like means and two conduits connected thereto, taken along the line IV—IV of FIG. 3.

FIGS. 2, 3, and 4 show a preferable vessel 21 forming the dust collecting zone 20 positioned between the upstream combustion zone 10 and the downstream desulfurizing zone 30. The vessel 21 forms a lower part of the vertical lower chamber 32 of the desulfurizing zone 3, which shares the above mentioned lateral space with the downstream chamber 24*b* formed by the upper zone part 24 of the dust collecting zone 20, and further, forms a laterally extending conduit communicating with the gas outlet 13 of the combustion zone 10, which conduit forms the above mentioned other lateral space, denoted as 24A, shared by both the upstream chamber 24*a* formed by the upper zone part 24 of the dust collecting zone 20 and the combustion zone 10.

Referring to FIGS. 2 to 4, the baffle plate 25 faces the adjacent combustion zone 10 and is inclined relative to a vertical plane, so that the bottom of the baffle plate 25 is farther from the combustion zone 10 than is the top of the baffle plate 25. The highest point of the bottom edge line of the baffle plate 25 is at a center point between the two lowest points forming the opposite bottom corners, and extends straight from the central highest point to each of the bottom points. The vessel 21 has a lining 27 of a thermal refractory insulator over the inner surface.

The baffle plate 25 has a trough-like conduit 28, opening upward, arranged along the bent bottom edge line at the bottom over the width thereof. Each end of the trough-like conduit 28 is connected to a pipe conduit 29 extending downward along the inner surface of the lower zone part 22 of the dust collecting zone 20.

The vessel 21 for use in forming the dust collecting zone as shown in FIG. 2 is designed for a single combination of the combination zone 10 and the dust collecting zone 20 to be applied with the single desulfurizing zone 30, while FIG. 1 shows two combinations such as that of the combustion zone 10 and the dust collecting zone 20 with the single desulfurizing zone 30. In such a plurality of combinations as those shown in FIG. 1, the vertical lower chamber 34 of the single desulfurizing zone 30 formed partially by such a vessel 21 as that shown in FIG. 2 is designed to open laterally to the downstream chambers **24*b* formed by the plural dust collecting zones 20**, respectively.

With the above mentioned arrangement of the two bed type boiler I, pulverized coal is continuously supplied to the fluidized bed of the sand formed by the air continuously fed into the upper chamber 14 of the combustion zone 10 through the distribution plate 15. The supplied coal is effectively burnt with the fluidizing air in the fluidized state to generate combustion heat and produce flue gases with fly ash. A part of the generated heat is recovered by the heat exchanger 2 both directly and indirectly in the fluidized bed using the fluidized sand as the heat medium as stated above, to produce steam in the heat exchanger 2.

The flue gases entraining ash particles and unburnt coal are forced to flow into the dust collecting zone 20, where most of the solid particles are separated from the flue gases and move downward toward the outlet 23. The flue gases entraining a reduced amount of the solid particles are forced to flow from the dust collecting zone 20 into the desulfurizing zone 30 to fluidize the particulate limestone over the distribution plate 35. The fluidizing flue gases are subjected to a desulfurizing process when in contact with the fluidized limestone. The desulfurized flue gases are passed through the first heat waste boiler 3 and then the second heat waste boiler 4 to impart heat to both boilers for the production of steam. The resultant flue gases are forced to flow out of the boiler system through the duct 56 while the solid particles as waste ash are separated from the flue gases by the particle separator 50 and discharged through the line 52.

With the dust collecting zone 20 designed as shown in FIGS. 2 to 4, the flue gases produced in the combustion zone are fed into the upstream chamber **24*a* and forced to impinge against the baffle plate 25 and then flow down toward the lower zone part 22 having the particle outlet 23. The flow of the flue gases is forced to turn upward toward the downstream chamber 24*b*, and then toward the lower chamber 32 of the desulfurized zone 30, while most of the solid particles entrained in the flue gases are guided by the baffle plate 25 to move downwards along the surface of the plate 25 facing the combustion zone, and then are received by the trough-like conduit 28. The solid particles collected as such are moved by gravity through the trough-like conduit and the two conduits 29 towards the outlet 23**.

The solid particles collected by the dust collecting zone 20 are purged by operation of the rotary valve 23 and are forced to move toward the heat exchanger 5 through the conduit 26.

While the combustion takes place in the fluidized bed of the combustion zone 10, some of the hot fluidized solid particles including sand, ash and unburnt coal are forced to flow continuously out of the combustion zone 10 and are then fed into the particle separator 60 through the conduit 18. The smaller size particles selected by the separator 60 are forced to return to the fluidized bed of the combustion zone 10 for re-use, and the large size particles are dumped after undergoing heat recovery by the heat exchanger (not shown).

From the viewpoint of realizing an effective fluidized bed combustion, a preferable size of the pulverized coal ranges from 0.4 to 3 mm. However, in practice, particulate coal including ash particles such as culm must be used. Such particulate coal includes an increased amount of ash particles having a size larger than 6 mm. In this regard, it is very advantageous to remove a part of the particles forming the combustion fluidized bed, separate the removed particles into smaller size particles having a size less than 3 mm and larger size particles by the separator 60, and return the smaller size particles to the combustion fluidized bed through the line 64.

Such a recycling of the smaller size particles, causes the particles having a size less than 0.4 mm to flow out of the combustion zone as fly ash, and thus most of the fly ash is collected by the dust collecting zone and then discharged from the boiler system.

The dust collecting zone 20 is formed by an impinging type inertia dust collector as shown in FIGS. 2 to 4. This type of dust collector is very advantageous, in comparison with a conventional cyclone, in that it is not necessary to increase a flow rate of the gases passing through the collector, and thus any pressure loss incurred in the collector is greatly reduced. This feature allows an efficient concurrent working of two fluidized beds in series, due to air fed for the upstream fluidized bed. In other words, if a cyclone is used instead of this collector, the increased pressure lose in the fluidizing gases would make it difficult in practice to obtain an efficient concurrent working of the two fluidized beds with the same gases stemming from air fed into the upstream fluidized bed.

Although the dust collector according to the present invention is provided with conduits 29 along the inner surface of the lower zone part, these conduits 29 have a low flow resistance against the flue gases, which can be ignored in practice since they are located in a low flow rate zone. Further, since the flue gases flow at a reduced flow rate in the two fluidized beds between which the collector is positioned, a wear resistant lining on the inner surface of the collector is not required.

In this regard, a blanket of a thermal refractory insulator, which is less expensive, and easier to form into a lining, may be applied to the collector, as shown in FIGS. 2 and 3 by reference 27.

Further, the collector is also advantageous in comparison with the cyclone in that it requires a smaller installation space and has a smaller, more compact unit size than those of the cyclone.

The trough-like conduit 28 and the two conduits 29 connected thereto in the collector prevent a rescattering or re-flowing of the once captured solid particles, which enhances the collection efficiency.

The inclination of the baffle plate toward the downstream side reduces turbulence of the gases, compared with that of a vertical extension of this plate.

Also, the vertical length of the baffle plate 25 may be varied so that the collecting efficiency can be regulated.

Further, additional baffle plates as indicated by dotted lines 25*a* may be provided so that the collecting efficiency may be further regulated.

The two bed type boiler according to present invention as shown in FIG. 1 carries out both combustion and desulfurization with an increased efficiency, in comparison with a conventional single bed type boiler wherein a combustion zone is provided for forming a fluidized bed of particulate limestone instead of sand. This is because the upstream combustion zone of the present invention can be provided with an optimum bed temperature in the range of from about 950° C. to 1000° C. for the combustion of pulverized coal, but the single combustion zone with the limestone according to the prior art must use a lower bed temperature of about 800° to 850° C. preferably not for a combustion of the coal but for a desulfurization of the flue gases.

Further an average period of time for which the flue gases are in contact with the fluidized limestone for desulfurization is shorter in the single combustion zone of the prior art, since the flue gases produced in an upper or downstream part of the fluidized bed have little or no opportunity to come into contact with the fluidized limestone to produce a desulfurization reaction. In marked contrast, the downstream desulfurizing zone of the present invention allows all of the flue gases produced in the upstream combustion zone an equal opportunity to come into contact with the fluidized limestone, to produce a desulfurization reaction at an optimum bed temperature.

The two fluidized bed type boiler according to the present invention as shown in FIG. 1 carries out the desulfurization of flue gases produced in the boiler with an increased efficiency, in comparison with a conventional two bed type boiler wherein an upstream combustion zone forming a fluidized bed of sand and a downstream desulfurization zone forming a fluidized bed of particulate limestone are directly connected in a vertical arrangement by a gas distribution plate through which flue gases enter straight from the upstream zone to the downstream zone. This is because the desulfurization zone of the present invention receives hot flue gases from which hot ash has been removed to a great extent by the dust collecting zone 20, but the corresponding zone of the prior art receives flue gases carrying all of the ash allowed to pass through the distribution plate from the upstream combustion zone, and the ash obstructs desulfurization, as explained hereinafter with reference to FIGS. 5 to 7. Further, according to the prior art boiler, the flue gases carrying the hot ash are directly introduced, i.e., through a shortest passage, from the upstream combustion zone to the downstream desulfurizing zone. Such a direct introduction of the flue gases carrying the hot ash particles makes it relatively difficult to control the bed temperature of the desulfurizing zone to an optimum temperature for the desulfurization reaction, which is far lower than the optimum bed temperature for combustion to be carried out in the combustion zone, as previously stated.

Figure 5:
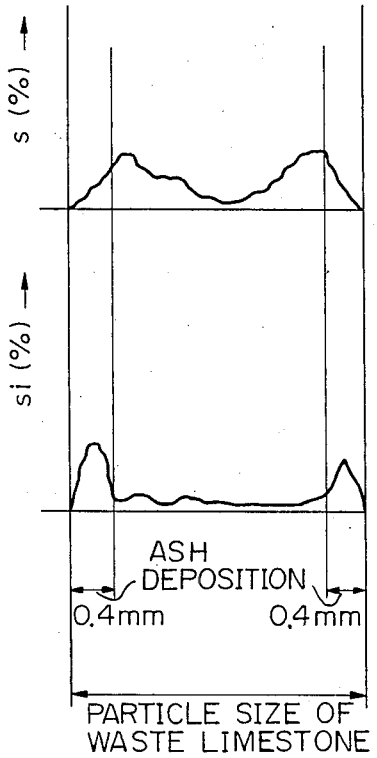
Fig. 5 ( PRIOR ART )
FIG. 5 and FIG. 6 are micro probe analized diagrams comparatively showing variations of he Si content of the ash and the S content of the flue gases, both deposited on waste limestone discharged from desulfurizing zones incorporated in boilers of a two bed type according to prior art and the present invention, respectively.
Figure 6:
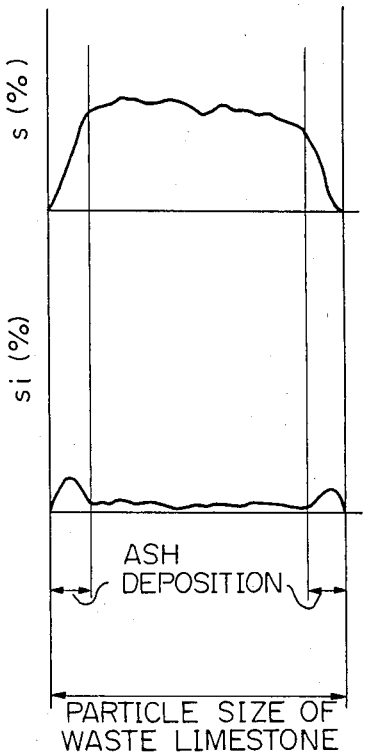

FIGS. 5 and 6 show the micro probe analized sulfur content (S) distribution and silicon content (Si) distribution in waste limestone particles discharged from the two bed type boiler of the prior art and that of the present invention, respectively. Referring to FIGS. 5 and 6, the waste limestones have a size of about 3 mm and a surface layer of about 0.4 mm wherein a high content of silica ($SiO_2$) as a representative ash is distributed. It can be seen that the sulfur content (S) is distributed least at the site where the ash is deposited and most at the site where the ash deposition is terminated. From FIG. 5, it can be understood that the amount of ash deposited on the surface of the waste limestone used in the conventional two bed type boiler is large, and thus the deposited ash clogs the pores of the original limestone particle so that $SO_3$ contained in the flue gases is prevented from penetrating to the interior of the particle through the pores, with the result that only a little sulfur (S) is captured by the limestone particle.

Figure 7:
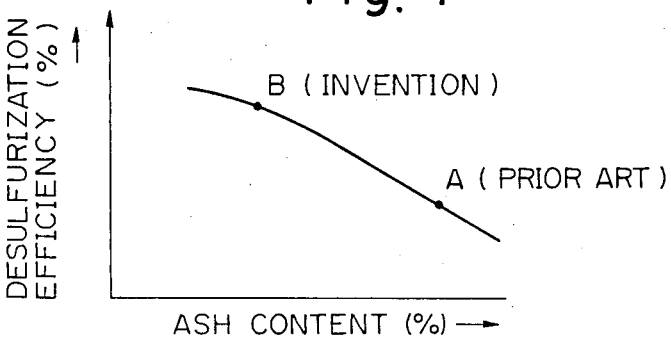
FIG. 7 is a diagram showing a desulfurization efficiency relative to ash content, wherein a comparison of the prior art and the present invention is indicated with the same amount of limestone used in the respective desulfurizing zones.

In marked contrast, FIG. 6 shows that the reduction of the amount of ash according to present invention, entrained in the flue gases, reduces the amount of the ash deposited to form the surface layer of the limestone particle, and in turn increases the amount of sulfur (S) stemming from the flue gases in the interior of the limestone particle. As a result, referring to FIG. 7, the efficiency of the desulfurization from the flue gases is low as shown by A in the prior art boiler, but markedly increased in the boiler of the present invention as shown by B, respectively. FIG. 7 shows a variation of the desulfurization efficiency relative to a content of ash introduced with the flue gases into the desulfurizing zone with a certain amount of limestone.

Figure 8:
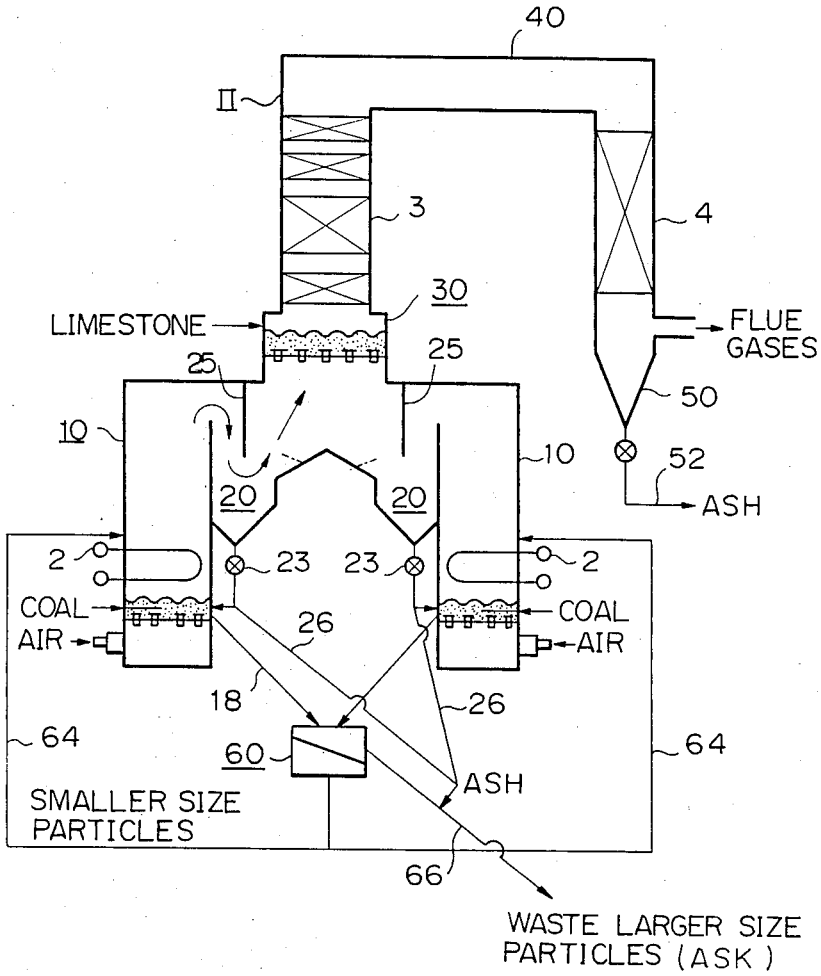
FIG. 8 is a partially sectional view corresponding to FIG. 1, showing another boiler of a two bed type according to the present invention, and featuring a connection of the dust collecting zone to combustion zone for returning collected solid particles, in comparison with the boiler shown in FIG. 1; and, FIG. 9 is a partially sectional view corresponding to FIG. 1, showing another boiler of a two bed type, and featuring a re-combustion zone forming a fluidized bed, in comparison with the boiler shown in FIG. 1.

A second embodiment boiler II of the present invention is shown in FIG. 8, wherein the same elements of the boiler II as those of the first embodied boiler I shown in FIGS. 1 to 4 are indicated by the same numerals.

In comparison with FIG. 8 and FIG. 1, the second embodied boiler II is substantially the same as the first embodied boiler I except that the outlets 23 of the dust collecting zones 20 are communicated with the fluidized beds of the combustion zones 10, respectively as indicated by arrow lines, so that part of the collected ash is returned to the combustion zones and that the conduit lines 26 from the outlets 23 are combined with the conduit line 66 so that the larger size particles discharged from the separator 60 and the remaining part of the ash discharged from the dust collecting zone 20 are dumped after heat recovery by a heat exchanger (not shown).

According to the second embodied boiler II, the partial return of the solid particles from the dust collecting zone 20 to the combustion zone 20 prevents a lowering of the bed temperature of the combustion zone 10 to a substantial extent, and thus improves the combustion efficiency compared to the first embodied boiler I. Further, as a whole, the second embodied boiler II purges less unburnt coal as waste material together with ash than the first embodied boiler I.

Figure 9:
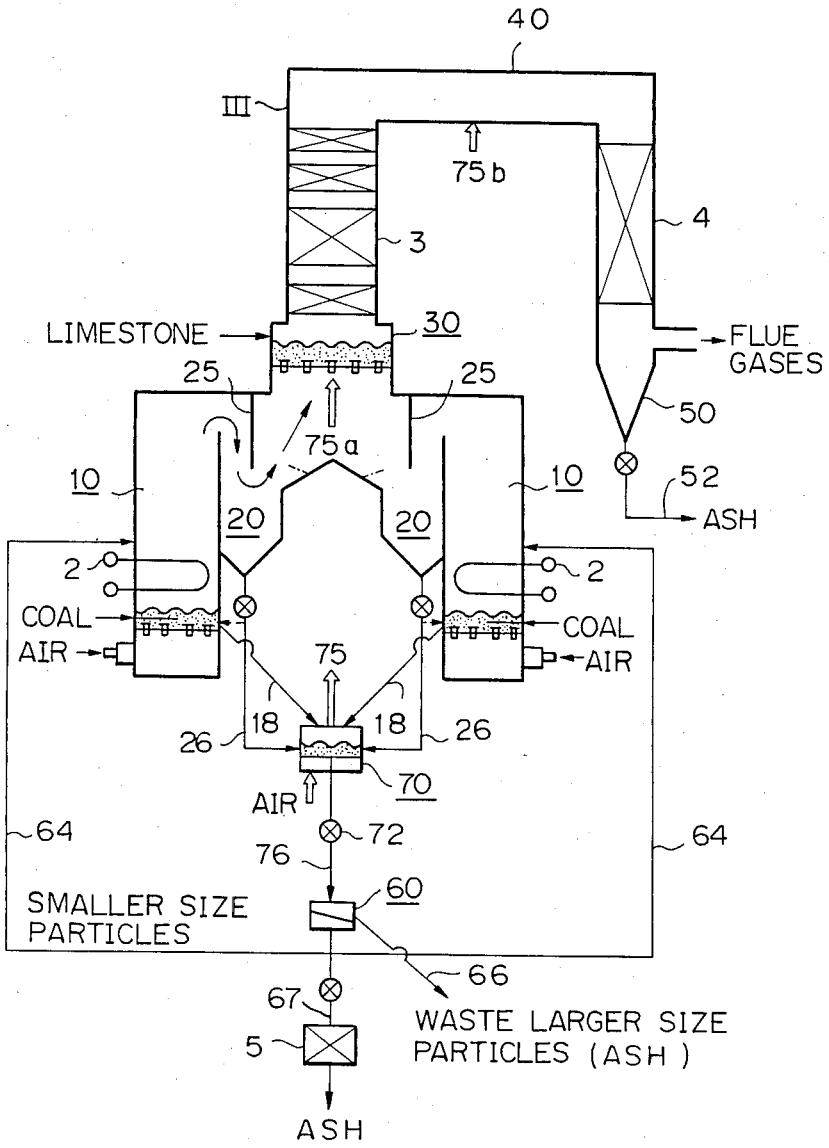

FIG. 9 shows a third embodied boiler III of the present invention, wherein the same elements of the boiler III as those of the first and second embodied boilers I and II are indicated by the same numerals.

The third embodied boiler III is substantially the same as the first embodied boiler I except that it is provided with re-combustion zone of a vessel having a gas distribution plate, which forms a fluidized bed of the solid particles removed partially from the fluidized bed of the combustion zones 10 and introduced through the conduits 18 and the solid particles discharged from the dust collecting zones 20 through the conduits 26 with air fed in a lower part of the vessel as a fluidizing and oxidizing gas and introduced into an upper part of the vessel through the distribution plate. The particle separator 60 communicates with the re-combustion zone 70 through a conduit 76 provided with a rotary valve 72, so that the fluidized solid particles are partially removed from the fluidized bed of the re-combustion zone 70 and fed to the particle separator 60. The smaller size particles selected by the separator 60 partially return to the fluidized bed of the combustion zone 10, through the conduit 64, and the remaining small size particles are discharged through a line 67 after heat recovery by a heat exchanger 5. The solid particles collected by the dust collecting zone 20 may be forced to partially return to the fluidized bed of the combustion zone 10 as indicated by a dotted arrow line, and the remaining collected particles may be fed to the re-combustion zone 70. The re-combustion zone 70 is designed so that unburnt coal supplied from the combustion zone 10 is burnt with the air fed in the fluidized bed of the hot solid particles including sand and ash supplied from the combustion zone 10, together with the unburnt particulate coal. The re-combustion takes place without the addition of a supplemental fuel such as fresh coal or heavy oil. This is because the solid particles at a temperature of about 900° to 1000° C. supplied from the fluidized bed of the combustion zone 10 impart sufficient heat energy to the fluidized bed of the re-combustion zone 70 to maintain the bed temperature at a preferable level for combustion of the unburnt coal. The upper part of the re-combustion zone 70 communicates with the lower chamber of the desulfurizing zone 30 as indicated by arrows 75 and 75*a*, and with the duct 40 between the first and second waste heat boilers 3 and 4 as indicated by arrows 75 and 75*b*, so that the flue gases produced in the re-combustion zone 70 are added to the flue gases produced in the combustion zone 10 in the desulfurizing zone 30. A conventional means (not shown) is provided for regulating a gas rate or a ratio of the flue gases fed from the re-combustion zone to the desulfurizing zone 30 at the upstream part thereof relative to that at the downstream part thereof.

A desulfurization load of the desulfurizing zone 30 can be adjusted by regulating the gas rates or the gas ratio of the flue gases by the regulating means to an optimum level, so that a maximum desulfurization efficiency is obtained in the given boiler.

Alternatively, the recycle line 64 with the separator 60 may be by-passed from the line 18 to the combustion zone 10 instead of that as shown in FIG. 9. In this case, the solid particles may be purged partially from the re-combustion zone 70 and discharged as waste particles after heat recovery.

Further, alternatively, the line 67 may be connected to the duct 40 upstream of the desulfurizing zone 30.

According to the present invention, one or a plurality of such combinations of the combustion zone 10 and the dust collecting zone 20 may be arranged around a single desulfurizing zone as indicated by 30 to form a compact two bed type boiler unit. Note, FIGS. 1, 8, and 9 all show two combinations, each of the combustion zone 10 and the dust collecting zone 20 with the single desulfurizing zone 30.

The first and second waste heat boilers of a conventional type 3 and 4 may be provided in parallel instead of in series as shown in FIGS. 1, 8 and 9.

We claim:

1. A fluidized bed boiler comprising a flue gas and ash producing combustion zone forming a fluidized bed of a particulate heat medium such as sand with air fed as a fluidizing and oxidizing gas and with sulfur-containing combustion particles such as pulverized coal supplied as a fuel, and provided with a heat exchange means therein, and a desulfurizing zone forming a fluidized bed of a particulate sulfur acceptor such as limestone with sulfur-containing flue gases stemming from said combustion zone fed as fluidizing gases to be desulfurized, characterized in that a dust collecting zone having an outlet collecting solid particles including fly ash entrained in the flue gases and discharging the collected solid particles through the outlet is provided such that said combustion zone, said dust collecting zone and said desulfurizing zone are arranged in this order to form a single and unitary passage for a flow of said flue gases.

2. A fluidized bed boiler according to claim 1, wherein said three zones arranged in said order are combined to form a lateral unit such that said combustion zone and said dust collecting zone share a first common lateral space, and said dust collecting zone and said desulfurizing zone share a second common lateral space.

3. A fluidized bed boiler according to claim 2, wherein said dust collecting zone comprises upper and lower zone parts, said upper zone part having a baffle plate provided to face said combustion zone and extend downwards from the ceiling of said dust collecting zone, said upper zone part being divided by said baffle plate into two chambers communicating with each other only through said lower zone part, one chamber directly communicating with said combustion zone through an opening provided at the top thereof to form an upstream end of said first common lateral space and the other chamber sharing said second common lateral space with a bottom part of said desulfurizing zone upstream of the fluidized bed thereof, said lower zone part converging downwards to communicate with the outlet of said dust collecting zone.

4. A fluidized bed boiler according to claim 3, wherein said baffle plate has an upwardly opening trough-like means extending at the bottom over the width thereof for collecting the solid particles guided by said baffle plate, two conduits each connected to one end of said trough-like means being provided to extend downwards along the inner side wall of said lower part for guiding the collected solid particles toward said outlet.

5. A fluidized bed boiler according to claim 4, wherein said baffle plate facing said combustion zone has a bottom edge line such that a top point is formed at the center between both bottom corners, from which top point the line extends downward and toward both bottom corners, said tough-like means extending along the bent bottom edge line of said baffle plate.

6. A fluidized bed boiler according to claim 5, wherein said baffle plate is inclined relative to a vertical plane, so that the bottom of said baffle plate is farther from said combustion zone than the top of said baffle plate connected to the ceiling of said dust collecting zone.

7. A fluidized bed boiler according to any one of claims 1 to 6, wherein said outlet of said dust collecting zone communicates with said combustion zone so that at least a part of the discharged solid particles is returned to the fluidized bed of said combustion zone.

8. A fluidized bed boiler according to any one of claims 1 to 6, further comprising a re-combustion zone forming a fluidized bed of a mixture of solid particles comprising unburned fuel with air fed as a fluidizing and oxidizing gas, both said combustion zone and said dust collecting zone communicating with said re-combustion zone so that the solid particles partially discharged from the fluidized bed of said combustion zone and all of the solid particles discharged from the outlet of said dust collecting zone, in combination, form said fluidized bed of said re-combustion zone, said re-combustion zone communicating with said desulfurizing zone at least at one of positions upstream and downstream of the fluidized bed thereof so that the flue gases are introduced from said re-combustion zone to said desulfurizing zone.

9. A fluidized bed boiler according to claim 8, wherein said re-combustion zone communicates with said desulfurizing zone at both the positions upstream and downstream of the fluidized bed thereof, and means is provided for regulating a ratio of a rate of flue gases introduced upstream of the fluidized bed to that introduced downstream thereof.

10. A fluidized bed boiler according to any one of claims 1 to 6, wherein a particle separator communicating with said combustion zone so that the solid particles in the fluidized bed of said combustion zone are partially discharged into said particle separator is provided for separating the discharged solid particles into smaller size particles and larger size particles, and a recycling conduit in cooperation with said separator is provided for returning the smaller size particles to the fluidized bed of said combustion zone.

11. A fluidized bed boiler according to claim 7, wherein a particle separator communicating with said combustion zone so that the solid particles in the fluidized bed of said combustion zone are partially discharged into said particle separator is provided for separating the discharged solid particles into smaller size particles and larger size particles, and a recycling conduit in cooperation with said separator is provided for returning the smaller size particles to the fluidized bed of said combustion zone.

12. A fluidized bed boiler according to claim 9, wherein a particle separator communicating with said re-combustion zone so that the solid particles in the fluidized bed of said re-combustion zone are partially discharged into said separator is provided for separating the discharged particles into smaller size particles and larger size particles, and a recycling conduit in cooperation with said separator is provided for returning the smaller size particles to the fluidized bed of said combustion zone.

13. A fluidized bed boiler according to any one of claims 1 to 6, wherein a plurality of combinations of said combustion zone and said dust collecting zone are provided and are arranged around said desulfurizing zone.

* * * * *

UNITED STATES PATENT AND TRADEMARK OFFICE

CERTIFICATE OF CORRECTION

PATENT NO. : 4,815,418

DATED : March 28, 1989

INVENTOR(S) : SADAHIKO MAEDA ET AL.

It is certified that error appears in the above-identified patent and that said Letters Patent is hereby corrected as shown below: Title page:

Assignee should read as follows:

-- Ube Industries, Ltd. --

Signed and Sealed this

Third Day of October, 1989

*Attest:*

DONALD J. QUIGG

*Attesting Officer*

*Commissioner of Patents and Trademarks*